US007627129B2

(12) United States Patent
Sporer et al.

(10) Patent No.: US 7,627,129 B2
(45) Date of Patent: Dec. 1, 2009

(54) APPARATUS AND METHOD FOR SUPPRESSING FEEDBACK

(75) Inventors: Thomas Sporer, Fuerth (DE); Christian Neubauer, Nuremberg (DE)

(73) Assignee: Fraunhofer-Gesellschaft zur Foerderung der angewandten Forschung e.V. (DE)

( * ) Notice: Subject to any disclaimer, the term of this patent is extended or adjusted under 35 U.S.C. 154(b) by 1129 days.

(21) Appl. No.: 11/055,353

(22) Filed: Feb. 8, 2005

(65) Prior Publication Data

US 2005/0190929 A1 Sep. 1, 2005

Related U.S. Application Data

(63) Continuation of application No. PCT/EP03/12437, filed on Nov. 6, 2003.

(30) Foreign Application Priority Data

Nov. 21, 2002 (DE) ..... 102 54 407

(51) Int. Cl.
*H04B 15/00* (2006.01)
*H04R 29/00* (2006.01)
*H04R 3/00* (2006.01)

(52) U.S. Cl. ..... 381/93; 381/83; 381/95; 381/96

(58) Field of Classification Search ..... 381/83, 381/93, 56, 59, 61, 66, 95–96, 111–117, 381/318

See application file for complete search history.

(56) References Cited

U.S. PATENT DOCUMENTS 4,747,144 A * 5/1988 Admiraal et al. ..... 381/93

(Continued)

FOREIGN PATENT DOCUMENTS

EP 55105494 8/1980

(Continued)

OTHER PUBLICATIONS

Antweiler, Christiane; Symanzik, Horst-Gunter; "Simulation of Time Variant Room Impulse Responses"; 1995 Int'l Conference on Acoustics, Speech, and Signal Processing, May 9-12, 1995, vol. 5, pp. 3031-3034.

(Continued)

*Primary Examiner*—Xu Mei
(74) *Attorney, Agent, or Firm*—Beyer Law Group LLP

(57) ABSTRACT

An apparatus for suppressing feedback in an environment where a microphone and a loudspeaker are located, comprises a means for embedding a test signal into a loudspeaker signal, a microphone signal or a modified microphone signal, preferably by using a psychoacoustic masking threshold by using a pseudo-noise test signal, a means for determining a characteristic of a transmission channel in the environment between the loudspeaker and the microphone by using the embedded test signal and the microphone signal, a filter for filtering the loudspeaker signal to obtain a filtered loudspeaker signal, wherein the filter is adaptable to be adapted with regard to its filter characteristic to the characteristic of the transmission channel by the means for determining, as well as a means for subtracting the filtered loudspeaker signal from the microphone signal to obtain the modified microphone signal, in which the feedback is reduced due to the loudspeaker signal. The feedback suppression concept provides an effective feedback suppression without audio quality loss, by which particularly an artist is not affected in his artistic performance.

15 Claims, 4 Drawing Sheets

U.S. PATENT DOCUMENTS

| | | | | |
|---|---|---|---|---|
| 5,412,734 | A * | 5/1995 | Thomasson | 381/318 |
| 5,717,772 | A * | 2/1998 | Lane et al. | 381/93 |
| 5,910,994 | A * | 6/1999 | Lane et al. | 381/93 |
| 6,347,148 | B1 | 2/2002 | Brennan et al. | |
| 6,386,039 | B1 * | 5/2002 | Peters | 73/589 |
| 6,434,247 | B1 * | 8/2002 | Kates et al. | 381/312 |
| 6,792,114 | B1 * | 9/2004 | Kates et al. | 381/60 |
| 7,092,532 | B2 * | 8/2006 | Luo et al. | 381/93 |
| 7,162,044 | B2 * | 1/2007 | Woods | 381/93 |
| 7,197,152 | B2 * | 3/2007 | Miller et al. | 381/326 |
| 2002/0064291 | A1 | 5/2002 | Kates et al. | |
| 2006/0285709 | A1 * | 12/2006 | Barthel | 381/318 |

FOREIGN PATENT DOCUMENTS

| | | |
|---|---|---|
| EP | 58200690 | 11/1983 |
| EP | 0 415 677 | 3/1991 |
| EP | 0 581 261 | 2/1994 |
| EP | 0 930 801 | 7/1999 |

OTHER PUBLICATIONS

International Search Report; PCT/EP 03/12437; Nov. 6, 2003.

Translation of International Preliminary Report on Patentability; International Preliminary Examination Report; PCT/EP2003/012437.

* cited by examiner $$H(t)=\begin{bmatrix} h_0 & h_1 & 0 \\ 0 & h_0 & h_1 \\ 0 & 0 & h_0 \end{bmatrix}; \qquad p(t)=\begin{bmatrix} p_0 \\ p_1 \\ p_2 \end{bmatrix};$$

$$y=H\cdot p=p(t)*h(t)$$

cross corelation $$E\left\{\overbrace{H\cdot p}^{y(t)}\cdot p^{*T}\right\} =$$

$$=\lim_{N\ ¿\mu}\frac{1}{N}\sum_{i=0}^{N}(H\cdot p_i)\cdot p_i^{*T}=$$

$$=s_p^2\cdot H\cdot \boxed{E(Q\cdot Q^H)}$$

Q: coloring filter

APPARATUS AND METHOD FOR SUPPRESSING FEEDBACK

CROSS-REFERENCE TO RELATED APPLICATION

This application is a continuation of copending International Application No. PCT/EP2003/12437, filed Nov. 6, 2003, which designated the United States and was not published in English.

BACKGROUND OF THE INVENTION

1. Field of the Invention

The present invention relates to audio replay systems and particularly to audio replay systems in live environments.

2. Description of the Related Art

In typical rock concerts, there are high dynamics to the effect that e.g. the singer moves a lot on stage. The same often applies to the guitarist. On the other hand, in such a performance environment, the loudspeakers are disposed statically. Thus, it cannot be avoided that the singer with his microphone as well as, for example, the guitarist with the microphone attached to his guitar is sometimes closer to loudspeakers and sometimes further away from loudspeakers. While the case where the microphone is far away from a loudspeaker is unproblematic, the case where a microphone is very close to a loudspeaker is very problematic. Since there is a high amplification in the signal path from microphone to loudspeaker, launching the loudspeaker signal into the microphone leads to the microphone/loudspeaker system starting to oscillate. Such an oscillation is expressed as feedback at a certain frequency. It always occurs when the amplitude and phase condition is fulfilled. The specific phase condition, which is currently best fulfilled, determines the frequency, which is typically relatively high, so that a feedback is audible as loud howling. This howling is not only awkward for the listeners but also for the artists.

Expressed in a signal theoretical way, there is a channel from one or several loudspeakers to one or several microphones, which is strongly variable in time.

Known feedback suppressing techniques mix audible feedback sounds into the microphone and use filters to suppress a starting feedback.

Alternative feedback suppressing techniques use a so-called pitch shifting technique to shift the feedback to inaudible parts of the spectrum, so that stable feedback sounds are avoided.

While the first solution requires a short feedback to trigger a suppression, the other solution effects in some case a strange sound, which, for example, makes singing and intonating for artists difficult.

Particularly in multichannel systems, the two mentioned feedback suppressing solutions are very problematic, if not even impracticable.

SUMMARY OF THE INVENTION

It is the object of the present invention to provide an improved concept for suppressing feedback.

In accordance with a first aspect, the present invention provides an apparatus for suppressing feedback in an environment where a microphone and a loudspeaker are located, having: a means for embedding a test signal into a loudspeaker signal, a microphone signal or a modified microphone signal to obtain an embedding signal, wherein the microphone signal is output from the microphone and wherein the loudspeaker signal is input in the loudspeaker; a means for determining a characteristic of a transmission channel in the environment between the loudspeaker and the microphone by using the test signal and the microphone signal; a filter for filtering the loudspeaker signal or the embedding signal to obtain a filtered signal, wherein the filter is adaptable to be adapted to the characteristic of transmission channel with regard to its filter characteristic in response to the means for determining; and a means for subtracting the filtered signal from the microphone signal to obtain the modified microphone signal, in which a feedback is reduced.

In accordance with a second aspect, the present invention provides a method for suppressing feedback in an environment where a microphone and a loudspeaker are located, having the following steps: embedding a test signal into a loudspeaker signal, a microphone signal or modified microphone signal to obtain an embedding signal, wherein the microphone signal is output from the microphone and wherein the loudspeaker signal is input into the loudspeaker; determining a characteristic of a transmission channel in the environment between the loudspeaker and the microphone by using the test signal and the microphone signal; filtering the loudspeaker signal or the embedding signal to obtain a filtered signal, wherein the filter is adaptable to be adapted with regard to its filter characteristic through the characteristic of the transmission channel; and subtracting the filtered signal from the microphone signal to obtain the modified microphone signal wherein a feedback is reduced.

In accordance with a third aspect, the present invention provides a computer program with a program code which effects a method for suppressing feedback in an environment where a microphone and a loudspeaker are located, having the following steps: embedding a test signal into a loudspeaker signal, a microphone signal or modified microphone signal to obtain an embedding signal, wherein the microphone signal is output from the microphone and wherein the loudspeaker signal is input into the loudspeaker; determining a characteristic of a transmission channel in the environment between the loudspeaker and the microphone by using the test signal and the microphone signal; filtering the loudspeaker signal or the embedding signal to obtain a filtered signal, wherein the filter is adaptable to be adapted with regard to its filter characteristic through the characteristic of the transmission channel; and subtracting the filtered signal from the microphone signal to obtain the modified microphone signal wherein a feedback is reduced, when the computer program is run on a computer.

The present invention is based on the knowledge that an effective feedback suppression can be achieved in that a microphone signal, which is a superposition of a useful signal and a feedback signal coming from one or several loudspeakers, is processed prior to mixing and amplifying, respectively, to the effect that the feedback portion is subtracted from the microphone signal, so that after the subtraction merely the useful signal remains.

Independent of the fact whether the feedback signal component is large in the case of an unfavorable channel, which means the microphone is very close to the loudspeaker, or is small in the case of a favorable channel, which means the microphone is relatively far away from the loudspeaker, the feedback signal component is preferably continuously removed from the microphone signal. Therefore, it is necessary to synthetically determine the feedback signal component at the microphone.

Therefore, according to the invention, a marking operation is performed to the effect that the signal emitted by the loudspeaker can be detected. This is achieved by embedding a test signal either into the microphone signal after subtraction or into the microphone signal prior to subtraction or into the signal after mixing and amplifying, which means into the replay signal for a loudspeaker, which is, e.g., present in digital form.

Further, according to the present invention, a means for determining a characteristic of a transmission channel from the loudspeaker to the microphone or, directly, for a feedback circulation from a microphone back to itself by using the received microphone signal, which is a superposition of the feedback signal and the useful signal, and by using the known test signal that has been embedded, is used.

A preferred procedure for determining the characteristic of the transmission channel in the environment between the loudspeaker and the microphone is to perform a cross correlation between microphone signal and test signal. The cross correlation, for example, provides the impulse response of the channel between the examined loudspeaker and the examined microphone directly. Alternative channel determination methods can also be used.

By using the determined characteristic of the transmission channel, a filter is adjusted, which filters the loudspeaker signal to obtain a filtered loudspeaker signal. In other words, the time-variant channel from the loudspeaker to the microphone is "simulated", to synthetically calculate the feedback signal fed into the microphone, so that it is available for the subtraction means.

The present invention performs an optimum feedback suppression when the channel changes merely slowly. This is very often the case in concerts with regard to the movements effected by human artists. Even when an artist performs a very fast movement, this fast movement does not last very long, so that a short fast movement is followed by a slow movement or even a break. The inventive system is able to suppress feedback not only anew in the beginning of the "transient oscillation", but also during the transient oscillation, to the effect that a feedback that has possibly already started can be suppressed again, i.e. subtracted out, during the development.

On the other hand, a fast movement often leads to the fact that the channel changes again to the "good", so that the microphone moves further away from the channel, which again leads to the fact that a feedback that might be developing dies down again without feedback suppression. Thus, in the suppression concept of the present invention, the demands on a time-constant channel are very low.

In the preferred embodiment of the present invention, the test signal is a pseudo-noise sequence, which can be generated easily, fast and inexpensively, for example by using feedback shift registers, and which is easily reproducible when such a shift register is made available at several positions. Particularly, several shift register means, which are to generate such a pseudo random sequence, can be initialized with the same starting value or "seed". It is known that pseudo-noise sequences appear noise-like, but usually have a relatively large period length. Considered in the frequency range, the noise-like appearance of a pseudo-noise sequence expresses such that the pseudo-noise signal has a wide spectrum, such that all frequencies occur with the same intensity. When the dynamics of the microphone signal are fairly well known, this white pseudo-noise signal can be mixed-in directly, when it is made sure that the level of the mixed-in pseudo-noise signal is relatively small and does not lead to audible interferences and to merely slightly audible interferences, respectively.

In order to improve the effectiveness of the feedback suppression, i.e. the channel simulation, it is preferred to evaluate the test signal, independent of the fact whether it is a pseudo-noise signal or not, by using a microphone signal, which is preferably already freed of its feedback portion or by using a psychoacoustical masking threshold derived from the amplified microphone signal, which means the loudspeaker signal.

Adding the test signal evaluated in that way to the microphone signal and the loudspeaker signal, respectively, leads to the fact that the embedded test signal will not be audible for the listener, so that the listener will not notice the constantly running feedback suppression procedure.

In other words, in that case, the feedback suppression has no negative consequences with regard to the replay quality perceived by the listener. On the other hand, for an effective suppression, which means for a determination of the impulse response of the channel between the loudspeaker and the microphone that is as exact as possible, which means for the exact simulation of the feedback portion, a test signal with as much energy as possible in the loudspeaker signal is desirable. The maximum energy is achieved without losses with regard to the audio quality when the test signal is a pseudo-noise signal, which means the same extends across the whole relevant frequency range, and is weighted psychoacoustically such that it is below the masking threshold of the loudspeaker signal. Thus, in signal portions of the loudspeaker signal with high masking effect, the test signal is present with high energy, while in signal portions of the loudspeaker signal with low masking effect, for example in tonal audio portions, the test signal is present with relatively little or no energy, to the effect that the listener has no audio quality losses.

Here, it should be noted that in the case where the microphone is not directly in front of the loudspeaker, rather loud loudspeaker signal passages are problematical. Due to the fact that in such loud loudspeaker passages the acoustic masking threshold is normally relatively high, a significant test signal energy is contained in such problematic loudspeaker signal portions, which directly leads to the fact that the channel determination and thus the feedback suppression takes place more exactly and thus more effectively. Thus, the concept of using a pseudo-noise test signal in connection with a psychoacoustic weighting and coloring, respectively, of the pseudo-noise test signal, which is preferred for the present invention, leads to the fact that exactly in the case where a well-functioning feedback suppression is needed, which means in the case of loud signals, a good channel determination with high signal noise ratio can be performed as well. The good feedback suppression that is urgently required in such a case is provided according to the invention.

The present invention is particularly suitable for multichannel environments, where several microphones and several loudspeakers are present. The usage of different test signals embedded into the individual microphone signals, which are preferably orthogonal to one another, and the usage of a cross correlation means for the determination of every relevant channel leads to the fact that the optimum feedback portion can be calculated for every microphone. Thereby, a flexible feedback suppression and exactly adapted to the individual microphone signals takes place, since every channel is simulated individually.

It can be seen that for the case where several microphones and several loudspeakers are provided at different locations, the computing effort for channel determination, preferably by using a cross correlation, can become immense. However, this is not problematic, since a typical amplifying equipment, such as a PA system, comprises a mixing console with significant dimensions and significant costs, wherein in such a setting several digital signal processors for calculating the channel characteristics and for suppressing the feedback portions will not make a big difference with regard to the overall costs of the equipment.

On the other hand, the present invention effects an efficient feedback suppression without negative consequences both for the listeners as well as particularly for the artists, with typically almost negligible costs with regard to the overall system. Particularly, it is emphasized that the artists are not disturbed in their artistic expression, such that they hear, for example, "tuned-in" audible feedback suppression sounds or that, in the case of pitch shifting, the signals perceived by the artist have a different pitch than the ones sung by the artist. Although already nuances with regard to the pitch shift would be sufficient for this known feedback suppression, these are still annoyances for the artist, which might limit him in is artistic expression. On the other hand, it is the artist who finally determines what equipment has to be provided for him. Thus, a market acceptance of the inventive concept is to be expected, since the inventive feedback suppression concept does not annoy the artist and allows him a maximum freedom of movement, so that he can use the whole stage for his artistic expression without having to fear undesired feedback sounds, independent of whether he comes near a loudspeaker component with feedback-risk or not.

Depending on the embodiment, the test signal can be embedded directly into the loudspeaker signals, which means prior to the analog-digital conversion and acoustical replay. In that case, the adaptation to the psychoacoustic characteristics of the loudspeaker signal will be best, since the psychoacoustic model of the loudspeaker signal will directly express what the audience hears or not.

Further, embedding into the loudspeaker signal has the advantage that transmitting functions from every loudspeaker to every microphone can actually be simulated individually and be used for feedback suppression. This inventive alternative leads to a better sound quality for the listener, but requires more computing effort in that when, for example, three microphones and three loudspeakers are present, already nine different transmission channels have to be determined with regard to their characteristics, have to be simulated, typically with FIR filters, and have to be used for subtraction, wherein prior to the actual subtraction of the whole feedback signal an addition of the three individual simulated feedback signals, in the described case provided by three loudspeakers, has to be performed.

A further alternative of the present invention is to embed the test signal into the modified microphone signal, which means after the subtraction, which means before the microphone signals are mixed and amplified, to obtain an embedding signal. The embedding signal is simultaneously used to be filtered and to feed the filtered signal to the subtraction means. Here, the psychoacoustic model is preferably calculated based on the modified microphone signal to obtain the masking threshold for optimum embedding.

The information about the psychoacoustic masking threshold can also be derived from the individual loudspeaker signals and supplied to the corresponding embedding means, which lies before mixing/amplifying, so that a better control of the test signal results.

As has been explained, the test signal should, on the one hand, be inaudible and, on the other hand, be present with as much energy as possible. If a psychoacoustic model is derived from a signal, which does not directly but only approximately correspond to the loudspeaker signal, the energy of the embedded test signal is held below the psychoacoustic masking threshold by a certain clearance, which avoids the deterioration of the audio quality but could lead to a poorer signal/noise ratio during the transmission channel determination and thus to a poorer feedback suppression.

On the other hand, in that case not many channels have to be calculated, so that this alternative can be formed with less computing time and can thus be used more cost effectively, particularly in smaller replay equipment or minimum replay equipment.

Further, the test signal can alternatively be inserted into the microphone signal prior to the feedback portion subtraction. When the feedback portion is calculated exactly, the embedded test signal will recover from the feedback portion subtraction relatively "undamaged", such that this case can be considered similar to the case where the test signal is already embedded into the modified microphone signal.

BRIEF DESCRIPTION OF THE DRAWINGS

These and other objects and features of the present invention will become clear from the following description taken in conjunction with the accompanying drawings, in which.

DESCRIPTION OF THE PREFERRED EMBODIMENTS

Figure 1A:
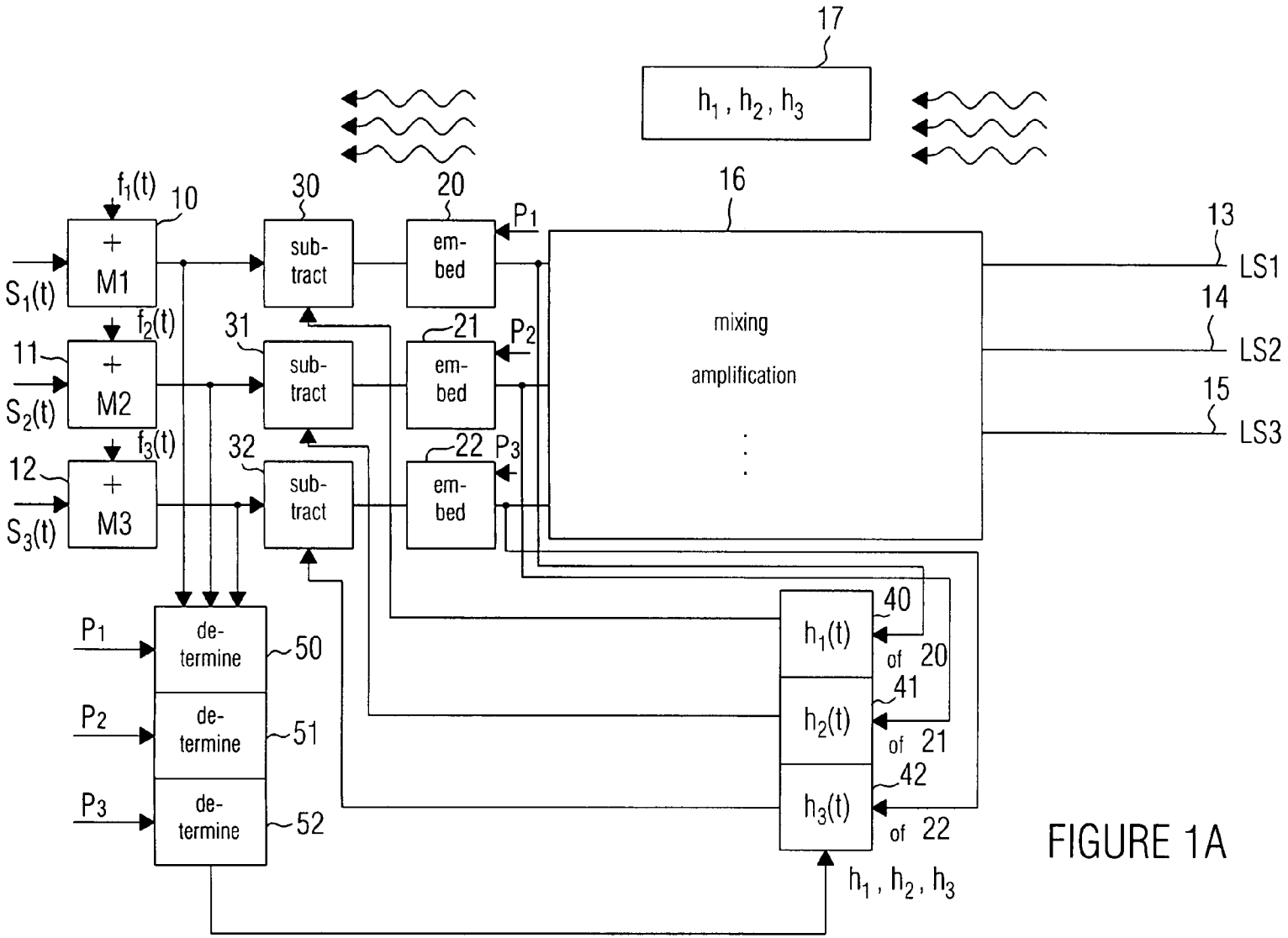
FIG. 1*a* is a preferred embodiment of the present invention in a multichannel environment with embedding on the microphone side.

FIG. 1 shows a preferred embodiment of the present invention in a multichannel setting where several microphones 10, 11, 12 as well as several loudspeakers 13, 14, 15 are disposed. A signal processing apparatus 16 is disposed between the microphones on the microphone side and the loudspeakers on the loudspeaker side, which is any sound equipment which can, besides other things, perform a mixing or amplification of the sound signal fed in by the microphones.

Signals from the three loudspeakers 13, 14, 15 superpose every microphone and form a feedback signal $f_i(t)$ for every microphone. The loudspeaker signals of the loudspeakers 13, 14, 15 are transmitted via a free space transmission channel 17, which can be defined such that a first transmission channel $h_1$ is defined from the three loudspeakers to the first microphone, that a second transmission channel $h_2$ is defined from the three loudspeakers to the second microphone 11, and that a third transmission channel $h_3$ is defined from the three loudspeakers to the third microphone 12.

In the embodiment shown in FIG. 1*a*, a test signal is embedded into a modified microphone signal by using an embedding means 20, 21, 22, to obtain a respective embedding signal for every microphone channel at the output of means 20, 21 and 22, respectively. Particularly, a first test signal $p_1$ is embedded into the modified microphone signal of the first microphone 10 to obtain a first embedding signal. A second test signal $p_2$ is embedded into the modified microphone signal of the second microphone 11 to obtain a second embedding signal. Finally, a third test signal $p_3$ is embedded into the modified microphone signal of the third microphone 12 to obtain a third embedding signal.

In order to get from a microphone signal at the output of the respective microphone 10, 11, 12 to a respective modified microphone signal, further, a subtraction means 30, 31, 32 is associated to every microphone. The subtraction means is formed to subtract a simulated feedback portion, which is, in the ideal case, equal to the feedback portion $f_i(t)$ received by the microphone, from the microphone signal. Thereby, in the ideal case, a modified microphone signal is present at the output of the respective subtraction means 30, 31, 32, which corresponds to the original useful signal $s_1(t)$, $s_2(t)$ and $s_3(t)$, respectively.

Figure 1B:
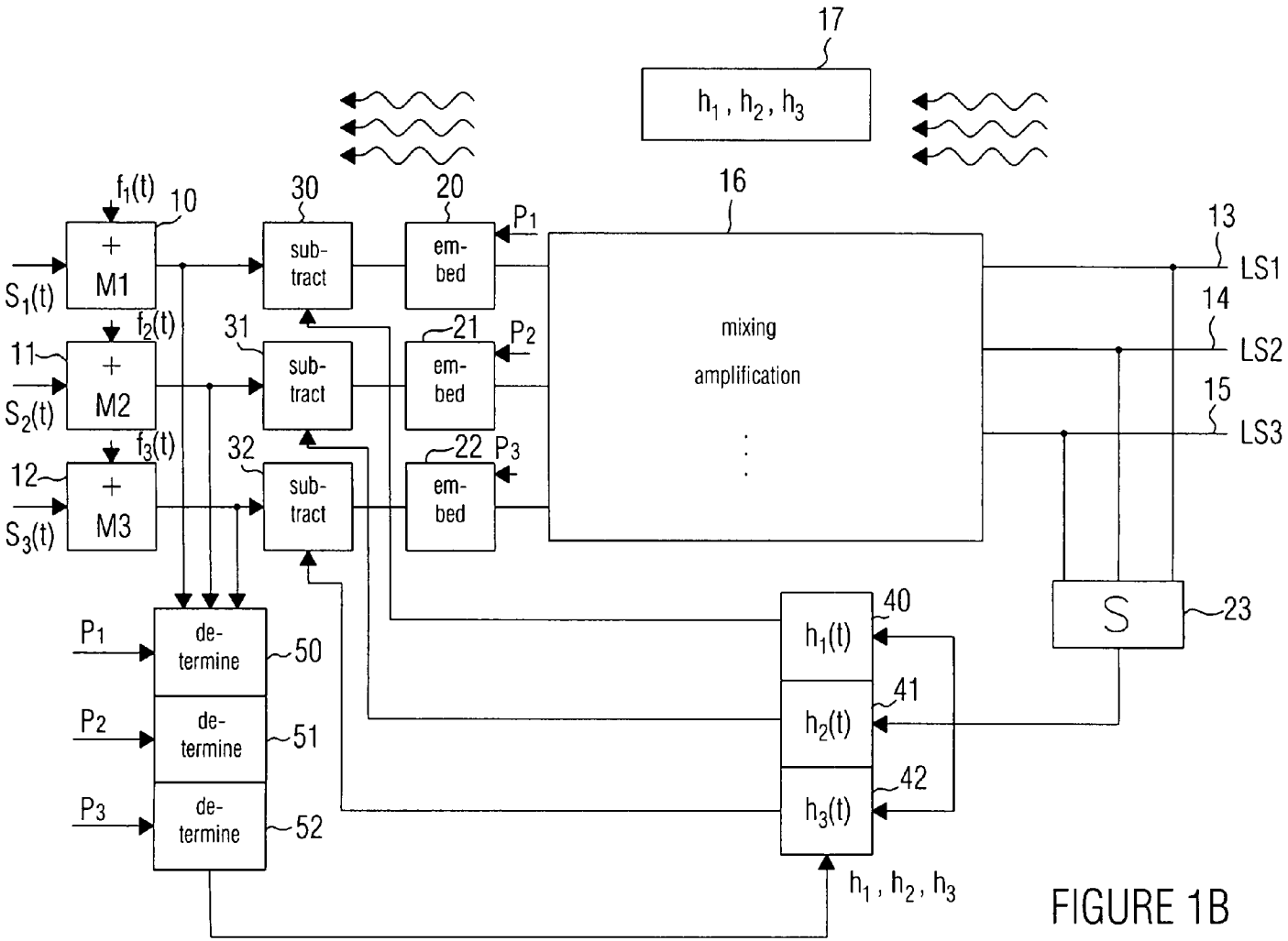
FIG. 1*b* is an alternative embodiment of the inventive feedback suppression concept with embedding on the microphone side.

An individual channel simulation filter 40, 41, 42 is associated to every microphone for simulating the feedback portions, wherein the first simulation filter 40 is formed to have the same channel impulse response $h_1(t)$ as illustrated in block 17, wherein in FIG. 1*b* not only the free space channel is associated to the representation in block 17, but also the transmission function by the block mixing/amplification 16. Here, it should further be noted that the simulated channel impulse response further comprises already the necessary delay.

Analogously, the second channel simulation filter 41 is formed to have the same channel impulse response $h_2(t)$, as outlined in block 17 (including mixing/amplification). Finally, the third simulation filter 42 is formed to have the same channel impulse response $h_3(t)$ as indicated in block 17 (including mixing/amplification).

The channel impulse responses for setting the simulation filter 40, 41, 42 are determined in respective means 50, 51, 52 for determining a characteristic of a transmission channel. Therefore, the first means 50 for determining obtains the test signal that has been fed into the modified microphone signal of the microphone 10. Analogously thereto, the second means 51 for determining obtains a test signal $p_2$, which has been used in the means 21 for embedding. Finally, the means 52 for determining obtains the same test signal $p_3$ for the third microphone that has been fed into the modified microphone signal of the third microphone.

In a preferred embodiment of the present invention, the three test signals $p_1$, $p_2$, $p_3$ are each pseudo-noise sequences, which are orthogonal to one another, so that the cross correlation performed in the means 50, 51, 52 for determining with the respective test signal $p_1$, $p_2$, $p_3$ can be discerned from the modified microphone signals provided with the other test signals and loudspeaker signals emitted therewith.

A cross correlation of, for example, the microphone signal of the first microphone 10 with the pseudo-noise sequence $p_1$ will lead to the fact that the modified microphone signals provided with the pseudo-noise sequences will be correlated out from the second and third microphones, so that merely the feedback portion actually to be subtracted from the microphone signal, which is problematical with regard to the generation of a feedback, will be subtracted.

It should be noted that typically, when no significant microphone/loudspeaker association changes are performed in short time periods in means 16, feedback signals from the two other microphones 11 and 12 are uncritical, since such feedback signals are uncritical with regard to feedback generation in the signal processing path, which leads from the first microphone to the three loudspeakers 13, 14, 15.

Further, in the embodiment of the present invention shown in FIG. 1*a*, for filter parameter calculation for every microphone channel, the embedding signal of this microphone channel is used and filtered. Particularly, at the output of means 20, the embedding signal is fed to the filter 40 for generating the filtered signal which is to be fed to the means 30. Correspondingly, the filter 41 is fed with the embedding signal from means 21. Above that, the filter 42 is fed with the embedding signal from means 22.

Here, it should be noted that the embodiment shown in FIG. 1*a* subtracts merely the signal problematical for feedback. Problematic for a feedback across the first microphone is so far only the (earlier) signal from the first microphone, that will be launched in again (later). Thus, in that case, it does not matter from which loudspeaker the first microphone a signal is played back. The channel calculated by correlation of the first microphone signal with the first test signal corresponds to a "feedback circulation", which means a circulation from a microphone via mixing/amplification, one and several loudspeakers, respectively, and the free space channel back to the microphone (including the transmission characteristic of the actually used microphone). Further, it should be noted that the determined impulse response $h_1$ "automatically" includes the delay occurring in the feedback circulation, so that no further measures have to be taken. Further, in that case, the situation is transparent in that the psychoacoustic masking threshold of the signal fed into the embedding means can be used for spectral coloring.

Alternatively, a loudspeaker signal could be fed back and fed into the filter. Depending on the main mapping of a microphone to a loudspeaker, the association to the effect that the loudspeaker signal 13 is filtered and fed back to the first microphone 10 is basically arbitrary. When the dominant association of the first microphone is more to loudspeaker 2, the loudspeaker signal of loudspeaker 14 would be fed back via the simulation filter 40 to the first microphone. The association of the loudspeaker signals to the microphones is thus to be seen merely exemplarily in FIG. 1*a* and can also vary from time to time depending on the mixing in the signal processing apparatus 16.

The embodiment of the present invention shown in FIG. 1*b*, which is an alternative to FIG. 1*a*, differs from the embodiment shown in FIG. 1*a* in that loudspeaker signals are fed back and not embedding signals, and that the signals of the different loudspeakers 13, 14, 15 are summed up in a summation means 23, and that then the loudspeaker sum signal is filtered with respective different simulation filters 40, 41, 42 to generate the three synthesized feedback portions, which are fed to the respective subtraction means 30, 31, 32, as it is shown in FIG. 1*b*. In this embodiment, it is assumed that the loudspeaker signals of all loudspeakers superpose in the transmission channel 17, and lead, for example, to a resulting feedback signal $f_1(t)$, which consists of signal portions of the first, second and third loudspeakers, modified by a correspondingly definable transmission function. For transmitting the sum signal of the three loudspeakers, which superpose in the free space transmission channel, to the first microphone, a first transmission function $h_1$ is defined. For transmitting the sum signal to the second microphone 11, a transmission function $h_2$ is defined, and, finally, for transmitting the sum signal to the third microphone 12, a resulting transmission function $h_3$ is defined.

Again, these transmission functions $h_1$, $h_2$, $h_3$ are preferably determined in the means 50, 51, 52 by cross correlation with the respective pseudo-noise sequence $p_1$, $p_2$, $p_3$, respectively, associated to a certain microphone. The form of the subtraction means 30, 31, 32 of the embedding means 20, 21, 22 as well as the simulation filters 40, 41, 42 is formed as in the embodiment described with reference to FIG. 1.

In the following, reference will be made to the further embodiment illustrated schematically in FIG. 2. Different to the embodiments shown in FIGS. 1*a* and 1*b*, embedding the test signal does not take place on the microphone side but on the loudspeaker side. Thereby, not only three different channels, but n×m different channels can be defined, wherein n is a number of loudspeakers higher or equal to 1 and wherein m is a number of microphones higher or equal to 1. By correlating the output signal of the first microphone 10 with the first test signal $p_1$, the channel from the loudspeaker 1 to the first microphone 1, which is designated with $h_{11}$, can be calculated. By correlating the output signal of the first microphone 10 by using the second pseudo-noise sequence $p_2$, the channel from the second loudspeaker 14 to the first microphone 10, which is designated with $h_{12}$, can be calculated. Analogous thereto, the channel from loudspeaker LS3 to the first microphone 1, which is designated by $h_{13}$, can be simulated by correlating the microphone signal of the first microphone 10 with a third pseudo-noise sequence $p_3$.

Analogous thereto, one can proceed for the output signals of the microphones 11 and 12, as it is indicated with reference to means 50, 51, 52 for determining. The means 50, 51, 52 are thus able to calculate an individual channel transmission function for the channel from every loudspeaker to every microphone, by which every individual loudspeaker signal can be convolved, which takes place in the simulation filters 40, 41, 42, to then calculate, for example, within the subtraction means 30, 31 and 33, respectively, or in an upstream block the resulting feedback portion for every microphone from the three channel output signals by addition, to obtain a resulting feedback portion. This is then subtracted from the feedback signal $f_i(t)$ fed into a respective microphone to obtain a modified microphone signal for every microphone where every channel has been selectively considered.

Depending on the embodiment, a means 50 for determining can be performed fully parallel, to calculate the channel impulse responses $h_{11}$, $h_{12}$ and $h_{13}$ simultaneously. The respective means could, however, also be designed in a serial way, wherein then a temporary storage is preferred with regard to an optimum time synchrony between the three channels $h_{11}$, $h_{12}$, $h_{13}$. By accepting a certain error, such a temporary storage could be omitted, such that the three belonging impulse responses of each loudspeakers 13, 14, 15 to the first microphone 10 are not related to the same period but to subsequent periods, which is, however, harmless, when the signals in a environment do not change too fast in relation to the time required for correlation.

Figure 2:
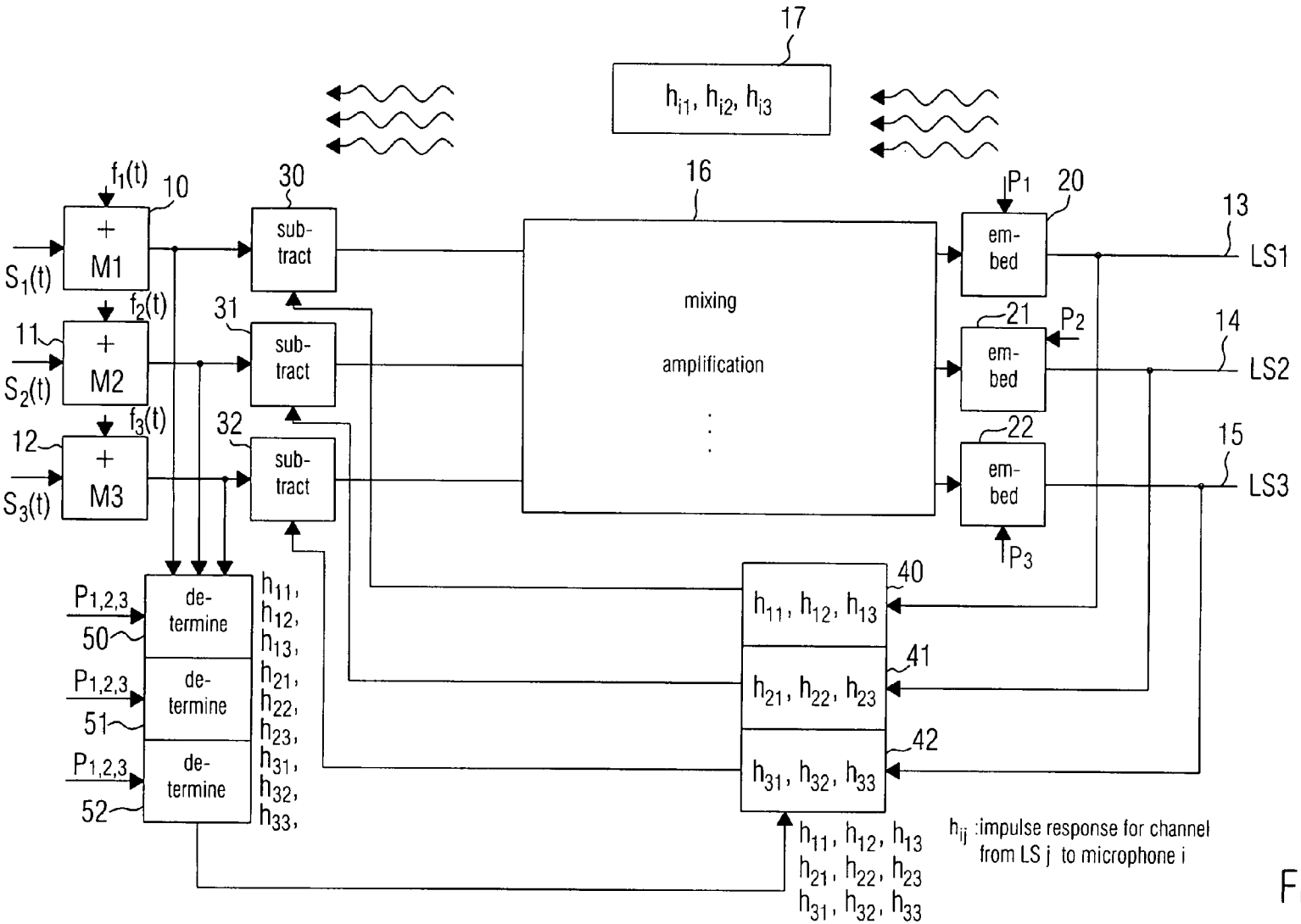
FIG. 2 is an alternative embodiment of the present invention with embedding on the loudspeaker side.

Also, filter means 40, 41, 42 can be formed in a serial or parallel way, wherein a parallel form offers the best results, in that an individual single simulation filter is provided for every possible channel of the channels possible in FIG. 2, such that the filter means 40, for example, actually comprises three individual simulation filters, whose filter coefficients are set by using the corresponding channel impulse response $h_{11}$, $h_{12}$, $h_{13}$. Adding-up the three simulated feedback portions from every loudspeaker into a resulting feedback portion could thus also be performed in the filter means 40 directly after the calculation of the respective impulse responses and the convolution of the loudspeaker signals with these impulse responses. In the embodiment shown in FIG. 2, as well as in the embodiments shown in FIGS. 1*a* and 1*b*, the three test signals $p_1$, $p_2$, $p_3$ should be as orthogonal as possible to one another. This condition can easily and safely be obtained by pseudo-noise sequences, wherein this characteristic is not lost by psychoacoustic filtering of the test signals prior to embedding.

In the embodiment shown in FIG. 2, it should be noted that a loudspeaker signal is the signal that a listener actually hears. With regard to an inaudible embedding of the test signals into the loudspeaker signals, the embedding can thus be performed best when the loudspeaker signals are used for calculating the psychoacoustic masking threshold.

That way, in the embodiment shown in FIG. 1*b*, a psychoacoustic model could also be calculated based on the respective loudspeaker signals 13, 14, 15 and used for embedding into the respective microphone signals in the means 20, 21 and 22, respectively. That way, in the psychoacoustic model, amplifications, which take place between the microphone and the loudspeaker in means 16, could be considered easily. If, however, a significant addition/subtraction and other processing of microphone signals, respectively, is performed in means 16, e.g. the case of a mixing procedure, so that a loudspeaker signal does not only mainly play back the output signal of a single microphone but output signals of several microphones, embedding a test signal by using the psychoacoustic masking threshold becomes less exact. This is due to the fact that, on the one hand, a single loudspeaker signal can not directly be used for calculating the psychoacoustic masking threshold, and, on the other hand, a microphone can not be used directly for calculating the psychoacoustic masking threshold. Since the mixing in the mixing console 16 is performed deterministically, it is preferred in such a case to calculate a psychoacoustic masking threshold of a signal simulated corresponding to the mixing procedure, to obtain a loudspeaker signal wherein the test signals of several microphones are embedded with a different or the same intensity when the loudspeaker signal is the combination of several microphone signals, wherein the test signals all in all, however, mainly follow the psychoacoustic masking threshold of a loudspeaker signal, so that embedding is achieved with maximum energy, while at the same time no or only negligibly small audio quality losses are effected.

In the following, it is summarized how the impulse response h(t) of a channel is determined by cross correlation. Therefore, a time-discrete test signal p(t) is applied to the channel. The channel outputs a receive signal y(t) on the output side, which, as it is known, corresponds to the convolution of the input signal with the channel impulse response. For the subsequent discussion of an procedure for determining the cross correlation with regard to FIG. 4, a matrix notation is used. As an example, a channel impulse response with only two values $h_0$ and $h_1$ without limitation of generality is assumed. The channel impulse response $h_0$, $h_1$ can be written as channel impulse response matrix H(t), which has the band structure shown in FIG. 4, wherein the other elements of the matrix are filled up with zeros. Above that, the excitation signal p(t) is written as vector, wherein it is assumed that the excitation signal has merely three samples $p_0$, $p_1$, $p_2$, without limiting the generality.

Figures 3, 4:
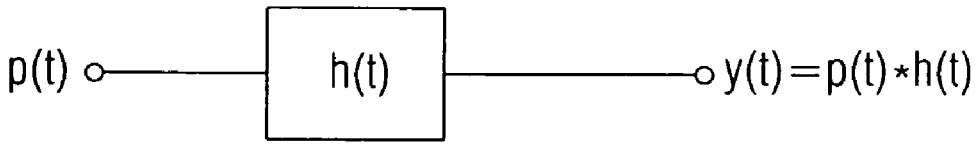
FIG. 3 is a basic diagram of a transmission channel.
FIG. 4 is a schematical abstract of the procedure for calculating an impulse response of the transmission channel shown in FIG. 3 by using a cross correlation.

It can be shown that the convolution shown in FIG. 3 corresponds to the matrix vector multiplication illustrated in FIG. 4, so that a vector y results for the output signal. The cross correlation can be written as expectation value E{ . . . } of the multiplication of the output signal y(t) with the conjugated complex transposed excitation signal $p^{*T}$. The expectation value is calculated as limiting value for N against infinity across the summation of individual products for different excitation signals $p_1$ illustrated in FIG. 5. The multiplication and subsequent summation results in the cross correlation matrix, which is illustrated in FIG. 4 in the top left, wherein the same is weighted with the effective value of the excitation signal p, which is illustrated by $\sigma_p^2$. For obtaining the channel impulse response h(t) directly, for example, the first line of the channel impulse response matrix is taken, whereupon the individual components are divided by $\sigma_p^2$ to obtain the individual components of the channel impulse response $h_0$, $h_1$ directly.

If a spectrally colored excitation signal is used instead of a white excitation signal p(t), the spectral coloring can be illustrated by a digital filtering, wherein the filter is described by a filter coefficient matrix Q. In the equation illustrated in the last line in FIG. 4, the correlation matrix H results also on the output side, but now weighted with the expectation value across $Q \times Q^H$. By dividing the individual impulse response coefficients $h_0$, $h_1$ through the expectation value across $Q \times Q^H$, which means by considering the coloring filter for example in means 50 for determining a characteristic of the conversion channel of FIG. 1*a*, 1*b* or 2, the channel impulse response can be determined directly with regard to its individual components.

It should be noted that the cross correlation concept for calculating the impulse response is an iterative concept, as can be seen from the summation approach for the expectation value. The first multiplication of the reaction signal with the conjugated complex transposed excitation signals provides already a first very coarse estimated value for the channel impulse response, which will be improved with every further multiplication and summation. If the whole matrix H(t) is calculated by the iterative summation approach, it will be found out that the elements of the band matrix H(t) set to zero in FIG. 4 on the upper left gradually approach zero, while in the middle, which means the band of the matrix, the coefficients of the channel impulse response h(t) remain and assume certain values. Again, it should be noted that it is not required to calculate the whole matrix. It is sufficient to calculate merely, for example, one line of the matrix H(t) to obtain the whole channel impulse response.

Here, it should be noted that the inventive concept is not limited to the procedure for calculating the cross correlation described with reference to FIG. 4. All other methods for calculating the cross correlation between a measurement signal and a reaction signal can also be used. Other methods for determining an impulse response instead of the cross correlation can also be used.

Here, it should be noted that the used pseudo-noise sequences should be dimensioned with regard to their length depending on the impulse response of the considered channel, which is to be expected. Thus, for larger acoustic environments, impulse responses with a length of several seconds are possible. This fact has to be accounted for by selecting a corresponding length of the pseudo-noise sequences for correlation.

Depending on the conditions, the inventive method can be implemented in hardware or in software. The implementation can take place on a digital memory medium, particularly a disc or CD with electronically readable control signals, which can cooperate with a programmable computer system such that the method is performed. Generally, the invention consists also of a computer program product with program code stored on a machine-readable carrier for performing the inventive method, when the computer program product runs on a computer. In other words, the invention can thus be realized as a computer program with a program code for performing the method when the computer program runs on a computer.

Here, it should again be noted that the inventive concept can be used for any number of microphones and any number of loudspeakers. This means, of course that the inventive concept can also be used for only one loudspeaker and one microphone. This results directly from FIGS. 1*a*, 1*b* and 2 when the second and the third microphone 11, 12 as well as the second and third loudspeaker 14, 15 are ignored and also the blocks addressed by these signals are omitted.

Here, it should further be noted that embedding the test signal does not necessarily has to take place into the modified microphone signal or the loudspeaker signal, but that embedding the test signal can also take place into the microphone signal prior to the respective subtraction means, although embedding the test signal after the subtraction means is preferred. This is due to the fact that in the case of a not so favorable channel impulse response calculation and thus in the case of a not particularly precisely synthesized feedback portion, the embedded test signal might be damaged by subtracting a not exactly fitting feedback portion, which might lead to a further impediment of the channel simulation through means 50, 51, 52.

Thus, in preferred embodiments of the present invention, a non-audible broadband signal is embedded into every microphone signal in a multichannel setting. This signal is adapted adaptably to the recorded sound with regard to its spectral envelope, wherein any psychoacoustic model can be used, which can be calculated based on time period data but also based on frequency range data. A pseudo-noise sequence is preferred as broadband signal, since in such a sequence an orthogonality between several sequences can easily be obtained.

For every microphone, the recorded signal is compared with the pseudo-noise signal prior to embedding and used to calculate the acoustic characteristics of all loudspeakers to the respective microphone. A cross correlation is preferred as comparison operation, which can be calculated without computing time effort with any scalable accuracy when the iterative algorithm shown in FIG. 4 is used. Particularly, the scalability provides the possibility to provide a fast but comparatively coarser calculation for specific situations, for example for a rock group, where there is a lot of movement on stage, while for other application scenarios, such as a rock group where the artists are rather static, e.g. a scaling towards a larger number of iteration values can be performed, since the individual channels are less time-variant.

By using a respective channel, an inverse filter is applied to suppress undesired components. According to the present invention, the inverse filter is realized by the simulation filters and the corresponding associated subtraction means. The usage of microphone signals enables a storage of spectrally formed PNS signals, so that an interference with original sound signals is avoided and a psychoacoustic model for calculating the spectral forming has to be calculated only once, and does not have to be calculated again in the respective means for determining.

Alternatively, as illustrated with regard to FIG. 2, a unique PNS signal is embedded into the signal from every loudspeaker. This procedure of embedding on the loudspeaker side enables the measurement of a path from every loudspeaker to every microphone. A suppression filter is used separately for every loudspeaker, whereby a better sound quality is achieved, but at the expense of a higher computing effort, which will, however, not make a big difference with regard to the overall costs of medium to larger sound equipment.

While this invention has been described in terms of several preferred embodiments, there are alterations, permutations, and equivalents, which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

What is claimed is:

1. An apparatus for suppressing feedback in an environment where a microphone and a loudspeaker are located, comprising:

an embedder for embedding a test signal into a loudspeaker signal, a microphone signal or a modified microphone signal to obtain an embedding signal, wherein the microphone signal is output from the microphone and wherein the loudspeaker signal is input in the loudspeaker; wherein the embedder is formed to spectrally color the test signal by using a psychoacoustic masking threshold, so that the embedded signal is essentially inaudible;

a processor for determining a characteristic of a transmission channel in the environment between the loudspeaker and the microphone by using the test signal and the microphone signal;

a filter for filtering the loudspeaker signal or the embedding signal to obtain a filtered signal, wherein the filter is adaptable to be adapted to the characteristic of transmission channel with regard to its filter characteristic in response to the processor for determining; and a subtracter for subtracting the filtered signal from the microphone signal to obtain the modified microphone signal, in which a feedback is reduced.

2. The apparatus of claim 1, wherein the test signal is a pseudo-noise signal.

3. The apparatus of claim 1, wherein the processor for determining is formed to perform a cross correlation by using the test signal and the microphone signal to calculate a channel impulse response as characteristic of the transmission channel.

4. The apparatus of claim 3, wherein the subtracter for subtracting is adapted to perform a sample wise subtraction in the time domain.

5. The apparatus of claim 3, wherein the filter is a digital filter whose coefficients can be adjusted such that an impulse response of the filter corresponds to the channel impulse response within a predetermined deviation threshold.

6. The apparatus of claim 1, wherein several microphone signals can be supplied from several microphones, wherein an individual embedder for embedding a test signal is provided for every microphone signal, wherein every embedder for embedding is fed with a different test signal to generate an individual embedding signal from every microphone signal, wherein the test signals are orthogonal to one another within a deviation threshold;

wherein a processor for determining is provided for every microphone signal which is each formed to determine a channel impulse response of a channel from a microphone via one or several loudspeakers back to the microphone, and wherein an individual filter is provided for every microphone signal to filter the embedding signal to obtain a filtered signal and to feed the filtered signal to a subtracter for subtracting for this microphone signal.

7. The apparatus of claim 1, wherein a plurality of loudspeakers and a plurality of microphones are provided, wherein an individual embedder for embedding the test signal into the modified microphone signal is provided for every microphone signal, wherein every embedder for embedding is fed with a different test signal, wherein the test signals are orthogonal to one another, wherein an individual embedder for embedding is provided for every microphone signal, which is each formed to obtain a channel impulse response based on a sum of signals of the loudspeaker to the corresponding microphones and by using a test signal associated for this microphone, and wherein it is provided for every microphone signal to filter the sum of loudspeaker signals with the filter, which has an impulse response, which has been determined by using the test signal associated to an examined microphone signal, and to supply it to the subtracter for subtracting for this microphone signal.

8. The apparatus of claim 1, wherein a plurality of loudspeakers and a plurality of microphones are present, wherein an individual embedder for embedding a test signal into a respective loudspeaker signal is provided for every microphone signal, wherein every embedder for embedding is fed with a different test signal, wherein the test signals are orthogonal to one another within a deviation threshold, wherein a processor for determining is provided for every microphone signal, which is each formed to calculate channel impulse responses for channels from every loudspeaker to the microphone, wherein the test signal embedded into the loudspeaker signal for the loudspeaker is used for a channel from a loudspeaker to a microphone, and wherein a plurality of filters is provided for every microphone signal, which is equal to a number of loudspeakers to filter every loudspeaker signal with an corresponding filter for a microphone signal, and to sum filtered loudspeaker signals from every loudspeaker to obtain a resulting synthesized feedback signal and to feed the resulting synthesized feedback signal to a subtracter for this microphone signal.

9. The apparatus of claim 1, further comprising:

a converter for converting one or several modified microphone signals into one or several signals from which the loudspeaker signals are derived.

10. The apparatus of claim 9, wherein the converter is formed to perform mixing and/or amplification of modified microphone signals.

11. The apparatus of claim 1, wherein the embedder for embedding a test signal is formed to embed the test signal into the loudspeaker signal, and wherein the embedder for embedding is further formed to perform embedding by using a psychoacoustic masking threshold of the loudspeaker signal.

12. The apparatus of claim 1, wherein the embedder is formed to embed the test signal into the modified microphone signal, and wherein the embedder is further formed to evaluate the test signal prior to embedding with a psychoacoustic masking threshold of the microphone signal.

13. The apparatus of claim 1, wherein a plurality of microphones and a plurality of loudspeakers are present, wherein further a mixer for mixing two or several modified microphone signals is present to generate one or several loudspeaker signals, and wherein the embedder is formed to perform embedding of several test signals into several microphone signals such that a resulting energy of the embedded test signals results under consideration of mixing, so that the resulting energy of the embedded test signals is in a signal for a loudspeaker below a psychoacoustic masking threshold of a loudspeaker signal for this loudspeaker.

14. A method for suppressing feedback in an environment where a microphone and a loudspeaker are located, comprising:

embedding a test signal into a loudspeaker signal, a microphone signal or modified microphone signal to obtain an embedding signal, wherein the microphone signal is output from the microphone and wherein the loudspeaker signal is input into the loudspeaker, wherein the embedder is formed to spectrally color the test signal by using a psychoacoustic masking threshold, so that the embedded signal is essentially inaudible;

determining a characteristic of a transmission channel in the environment between the loudspeaker and the microphone by using the test signal and the microphone signal;

filtering the loudspeaker signal or the embedding signal to obtain a filtered signal, wherein the filter is adaptable to be adapted with regard to its filter characteristic through the characteristic of the transmission channel; and subtracting the filtered signal from the microphone signal to obtain the modified microphone signal wherein a feedback is reduced.

15. A computer program product having a memory medium encoded with a program code which effects a method for suppressing feedback in an environment where a microphone and a loudspeaker are located, comprising:

embedding a test signal into a loudspeaker signal, a microphone signal or modified microphone signal to obtain an embedding signal, wherein the microphone signal is output from the microphone and wherein the loudspeaker signal is input into the loudspeaker, wherein the embedder is formed to spectrally color the test signal by using a psychoacoustic masking threshold, so that the embedded signal is essentially inaudible;

determining a characteristic of a transmission channel in the environment between the loudspeaker and the microphone by using the test signal and the microphone signal;

filtering the loudspeaker signal or the embedding signal to obtain a filtered signal, wherein the filter is adaptable to be adapted with regard to its filter characteristic through the characteristic of the transmission channel; and subtracting the filtered signal from the microphone signal to obtain the modified microphone signal wherein a feedback is reduced, when the computer program is run on a computer.

* * * * *

UNITED STATES PATENT AND TRADEMARK OFFICE

CERTIFICATE OF CORRECTION

PATENT NO. : 7,627,129 B2
APPLICATION NO. : 11/055353
DATED : December 1, 2009
INVENTOR(S) : Sporer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1333 days.

Signed and Sealed this

Second Day of November, 2010

David J. Kappos

David J. Kappos
*Director of the United States Patent and Trademark Office*